US006247798B1

(12) United States Patent
Cleland et al.

(10) Patent No.: US 6,247,798 B1
(45) **Date of Patent: *Jun. 19, 2001**

(54) INK COMPENSATED GEOMETRY FOR MULTI-CHAMBER INK-JET PRINTHEAD

(75) Inventors: Todd A. Cleland; Robert C. Maze, both of Corvallis, OR (US)

(73) Assignee: Hewlett-Packard Company, Palo Alto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/855,079

(22) Filed: May 13, 1997

(51) Int. Cl.[7] ..... B41J 2/05
(52) U.S. Cl. ..... 347/65
(58) Field of Search ..... 347/65, 63, 43, 347/100

(56) References Cited

U.S. PATENT DOCUMENTS 4,380,771 * 4/1983 Takatori ..... 347/43
4,963,189 10/1990 Hindagolla .
5,030,971 * 7/1991 Drake ..... 347/43 X
5,085,698 2/1992 Ma et al. .
5,143,547 * 9/1992 Kappele ..... 347/100 X
5,221,334 6/1993 Ma et al. .
5,274,400 * 12/1993 Johnson ..... 347/43
5,302,197 4/1994 Wichramanayke et al. .
5,623,294 * 4/1997 Takizawa ..... 347/100 X
5,666,143 * 9/1997 Burke ..... 347/65
5,725,641 3/1998 Macleod .
5,734,399 * 3/1998 Weber ..... 347/65
5,898,448 * 4/1999 Ishikawa ..... 347/43 X

FOREIGN PATENT DOCUMENTS 1-234255 * 9/1989 (JP) ..... B41J/3/04

* cited by examiner

*Primary Examiner*—Benjamin R. Fuller
*Assistant Examiner*—C. Dickens

(57) ABSTRACT

In accordance with the invention a multi-chamber printhead barrier design that is compensated for differences in ink properties is disclosed. The printhead comprises different groups of firing chambers, each group dedicated to a different ink. The barrier design is configured to a particular ink property such as viscosity, in order to provide similar ink refill characteristic for the different groups of firing chambers.

24 Claims, 7 Drawing Sheets

INK COMPENSATED GEOMETRY FOR MULTI-CHAMBER INK-JET PRINTHEAD

FIELD OF INVENTION

The present invention generally relates to a printhead for ink-jet printers, and, more particularly, to the design of barrier materials within a multi-chamber printhead.

BACKGROUND OF INVENTION

Ink-jet printing is a non-impact printing process in which droplets of ink are deposited on a print medium in a particular order to form alphanumeric characters, area-fills, and other patterns thereon. Low cost and high quality of the hardcopy output, combined with relatively noise-free operation, have made ink-jet printers a popular alternative to other types of printers used with computers.

An ink-jet image is formed when a precise pattern of dots is ejected from a drop-generating device, known as a "printhead", onto a printing medium. The typical ink-jet printhead has an array of precisely formed nozzles in an orifice plate attached to a thermal ink-jet printhead substrate. The substrate incorporates an array of firing chambers that receive liquid ink (colorants dissolved or dispersed in a solvent) from a supply channel (or ink feed channel) leading from one or more ink reservoirs. Each chamber has a thin film resistor, known as a "firing resistor," located opposite the nozzle. A barrier layer located between the substrate and the orifice forms the boundaries of the firing chamber and provides fluidic isolation from neighboring firing chambers. The printhead is mounted on and protected by an outer packaging referred to as a print cartridge.

When the resistor is heated, a thin layer of ink above the resistor is vaporized to create a drive bubble. This forces an ink droplet out through the nozzle. After the droplet leaves and the bubble collapses, capillary force draws ink from the ink feed channel to refill the nozzle.

The ink feed channel is carefully designed to provide optimal fluidic resistance. Optimal resistance guarantees that the meniscus in the nozzle returns to its equilibrium position in the minimum amount of time after firing of a drop of ink. This optimal fluidic resistance balances the need for quick refill against the need for well-behaved (well-damped) refill dynamics. The fluidic resistance is necessary to provide sufficient damping of ink movement in the nozzle during the refill portion of a drop ejection cycle. The properties of the ink greatly affect the damping requirements of the printhead. For example, less viscous inks reduce damping while more viscous inks increase damping.

In an under damped system, fluid rushes back into the ink-jet nozzle area so rapidly that it overfills the nozzle, creating a bulging meniscus. The meniscus then oscillates about its equilibrium position for several cycles before settling down. Extra fluid in the bulging meniscus adds to the volume of the emerging drop, while a retracted meniscus reduces the volume of the drop. The bulging meniscus in an underdamped pen can also lead to puddling of ink in the orifice plate surrounding the orifice bores. These ink puddles can interfere with proper drop ejection causing nozzle trajectory errors or even altogether blocking drop ejection.

In over damped pens the refill dynamics are too slow to keep up with the firing pulses sent by the printer. The result is that the pen is consistently firing on a retracted meniscus. Firing faster than the firing chamber can refill itself can also cause ingestion of air into the printhead, which results in erratic drop ejection.

For a given ink, the damping of the system can be increased by increasing the resistance of the ink refill channel. One way to do this is to lengthen the channel. An alternative way of increasing the resistance of the channel is by decreasing the channel cross section. The refill frequency which is dependent on damping is critical in designing high throughput ink-jet printing systems.

Ink-jet printheads having multiple chambers, where each chamber is dedicated to a given ink formulation are known in the art, such as that described in U.S. patent application Ser. No. 08/500796, now U.S. Pat. No. 5,734,344 by Weber et. al., entitled "Particle Tolerant InkJet Printhead Architecture." These multi-chamber printheads contain many firing chambers that are typically arranged in a group around an ink supply plenum for efficient and high quality printing. Additional groups of firing chambers may be located in the printhead to allow for individual ink colors to be printed from each group. In these multiple chamber printheads ink properties may vary for each ink color, and thus vary from chamber to chamber. Differences in key ink properties (e.g., surface tension, viscosity) may arise from attributes such as differences among the dyes, the ink vehicle, or other ink components and their concentrations. These differences in the inks lead directly to chamber-to-chamber differences in refill characteristics, as measured by $F_{2ss}$. $F_{2ss}$ is the frequency above which the weight of ejected droplets is always less than the steady-state drop weight. At frequencies above $F_{2ss}$ the pen is always firing with a retracted meniscus. In existing multi-chamber printheads, the same barrier design is used for all chambers even though each chamber uses a different ink. The use of the same barrier design may lead to one chamber being over damped while another is under damped.

Thus, there exists a need for a multi-chamber printhead barrier design that is compensated for differences in ink properties.

DISCLOSURE OF THE INVENTION

Briefly and in general terms, an ink-jet printhead for selectively ejecting a plurality of fluids in response to a print control system, said printhead comprises a first fluid geometry for providing fluid to a first firing chamber, said fluid geometry configured for a particular fluid parameter of a first fluid; and a second fluid geometry for providing fluid to a second firing chamber, said second fluid geometry configured for the fluid parameter of a second fluid, second fluid being different than the first fluid.

The invention further contemplates a process for forming a barrier layer having the steps of: providing a barrier layer; providing a mask having a plurality of designs, each design optimized for a different fluid; forming a plurality of fluid geometries on said barrier layer using said mask; said plurality of fluid geometries comprising a first fluid geometry for providing fluid to a first firing chamber, said first fluid geometry configured for a particular fluid parameter of a first fluid; and a second fluid geometry for providing fluid to a second firing chamber, said second fluid geometry configured for the fluid parameter of a second fluid, second fluid being different than the first fluid.

DETAILED DESCRIPTION OF THE INVENTION

Figure 1:
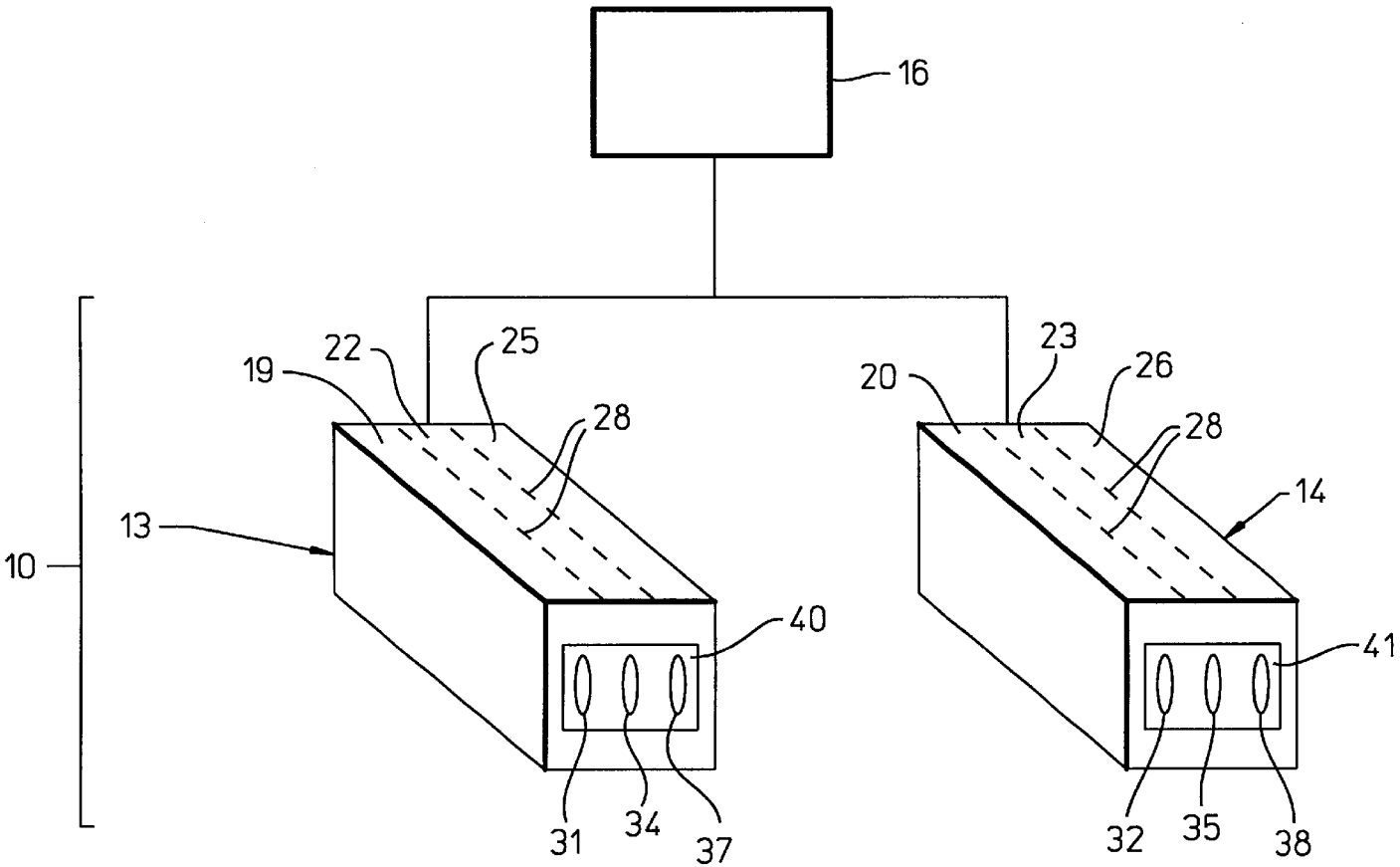
FIG. 1 is an isometric view of a print system embodying the invention.

FIG. 1 illustrates a printing system 10 embodying the invention. Reference numeral 13 generally indicates a multi-chamber print cartridge for selectively ejecting droplets of ink in response to a print controller 16. Print controllers of the type 16 are well known in the art. The print cartridge 13, has three ink reservoirs 19, 22, and 25 for housing dark magenta, light magenta, and yellow inks, respectively. The ink reservoirs, 19, 22, and 25, are divided by partitions 28, within the interior of the print cartridge 13. The partitions 28 are illustrated as dashed lines in FIG. 1. The inks in ink reservoirs 19, 22, and 25, are in fluid communication with three sets of nozzles, 31, 34, and 37 located on a printhead 40, respectively.

Further referring to FIG. 1, printing system 10 may optionally include a second multi-chamber print cartridge as indicated by reference numeral 14 for selectively ejecting droplets of ink in response to the print controller 16. The print cartridge 14 has three ink reservoirs 20, 23, and 26 for housing dark cyan, light cyan, and black inks, respectively. The ink reservoirs, 20, 23, and 26, are divided by partitions 28, within the interior of the print cartridge 14. The partitions 28 are illustrated as dashed lines in FIG. 1. The inks in ink reservoirs 20, 23, and 26, are in fluid communication with three sets of nozzles, 32, 35, and 38 located on a printhead 41, respectively.

Figure 2:
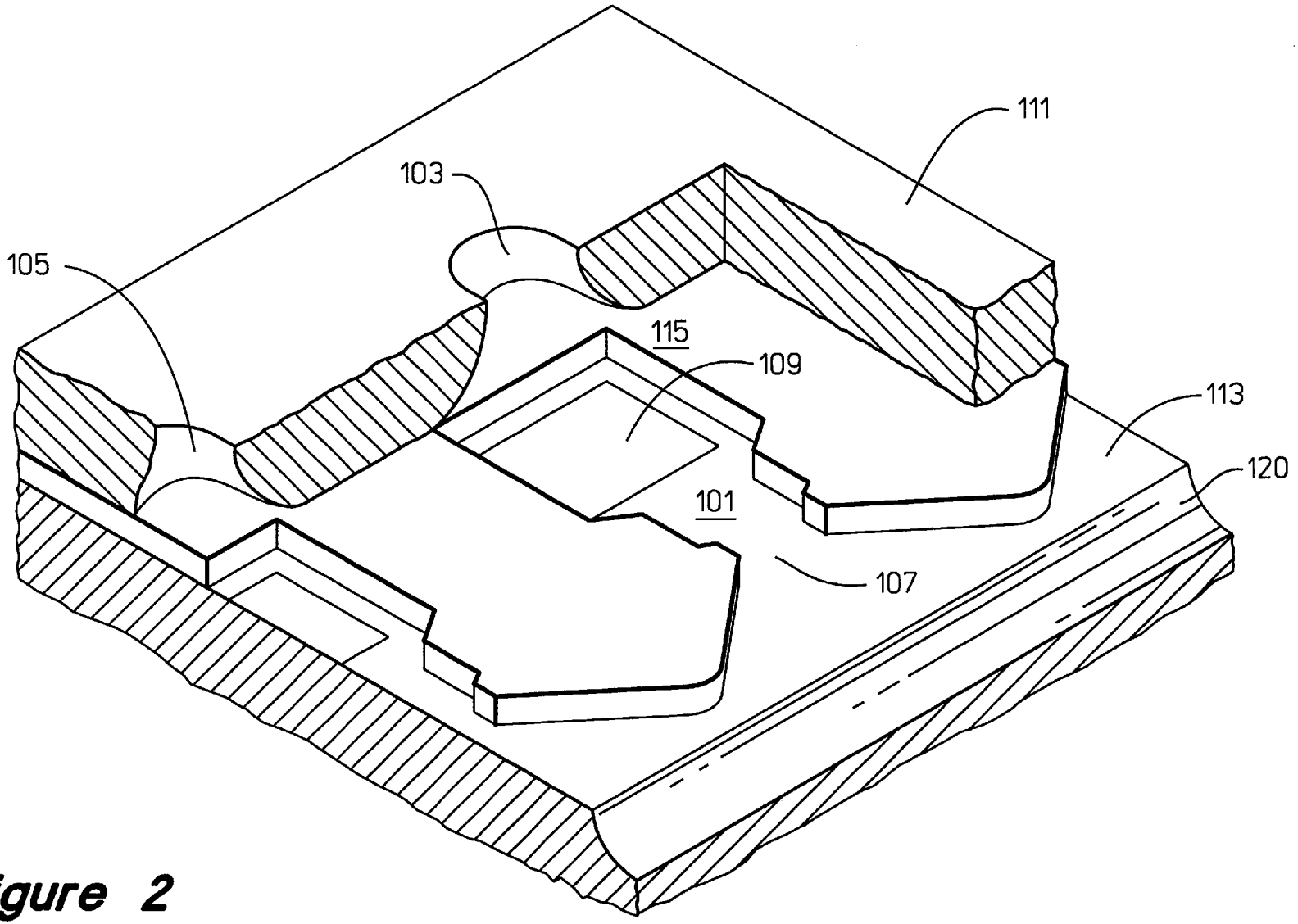
FIG. 2 is an isometric view of an inkjet printer printhead.

A greatly magnified isometric view of a portion of a typical ink-jet printhead for use in an ink-jet printer is shown in FIG. 2. Several elements of the printhead have been sectioned to reveal an ink firing chamber 101 within the ink-jet printhead. Several such firing chambers are arranged in a group around an ink supply (not shown) for efficient and high quality printing. Additional ink firing chamber groups are located in the printhead to allow other ink colors to be printed from each group. Associated with each firing chamber 101 is an orifice 103 disposed relative to the firing chamber 101 so that ink which is rapidly heated in the firing chamber by a heater resistor 109 is forcibly expelled as a droplet from the orifice 103. The walls of the firing chamber 101 are made up of a photosensitive polymer. This polymer serves to define the walls of the firing chamber 101 and determines the spacing between the resistor 109 surface and the bottom of the orifice plate 111. Part of a second orifice 105, associated with another ink firing chamber is also shown. The heater resistors are selected by a microprocessor and associated circuitry in the printer in a pattern related to the data sent to the printer so that ink which is expelled from selected orifices creates a defined character or figure of print on the medium. The medium (not shown) is typically held parallel to an orifice plate 111 and perpendicular to the direction of the ink droplet expelled from the orifice 103. Ink is supplied to the firing chamber 101 via an opening 107 commonly called ink feed channel. This ink is supplied to the ink feed channel 107 from a larger ink reservoir (not shown) by way of an ink slot 120 which is common to all firing chambers in a group.

Once the ink is in the firing chamber 101 it remains there until it is rapidly heated to boiling by the heater resistor 109. Conventionally, the heater resistor 109 is a thin film resistance structure deposited on the surface of a silicon substrate 113 and connected to electronic circuitry of the printer by way of thin film conductors deposited on the substrate 113. The heater resistor placement is typically staggered in three or more parallel lines of heater resistors with adjacent heater resistors placed non-colinearly. Printheads having increased complexity typically have some portion of the electronic circuitry constructed in integrated circuit form on the silicon substrate 113. Various layers of protection such as passivation layers and cavitation layers may further cover the heater resistor 109 to electrically isolate it from the ink and to extend resistor life. Thus, the ink firing chamber 101 is bounded on one side by the silicon substrate 113 with its heater resistor 109 and other layers, and bounded on the other side by the orifice plate 111 with its attendant orifice 103. The other sides of the firing chamber 101 and the ink feed channels 107 are defined by a polymer barrier layer 115. This barrier layer is preferably made of an organic polymer which is substantially inert to the corrosive action of the ink and is conventionally applied to the substrate 113 and its various protective layers and is subsequently photolithographically defined into desired geometric shapes. Polymers suitable for the purpose of forming a barrier layer 115 include products sold under the names Parad, Vacrel, IJ5000 and Riston by E. I. DuPont De Nemours and Company of Wilmington, Del. Such materials can withstand temperatures as high as 300° C. and have good adhesive properties for holding the orifice plate of the printhead in position. Typically the barrier layer 115 has a thickness of about 5 to about 50 microns, and more preferably from about 10 to about 30 microns after the printhead is assembled with the orifice plate 111.

The orifice plate 111 is secured to the silicon substrate 113 by the barrier layer 115. Typically the orifice plate 111 is constructed of nickel with a plating of gold or palladium to resistthe corrosive effects of the ink. Typically the diameter of an orifice 103 in the orifice plate 111 is approximately 10 to 50 microns.

Figure 3:
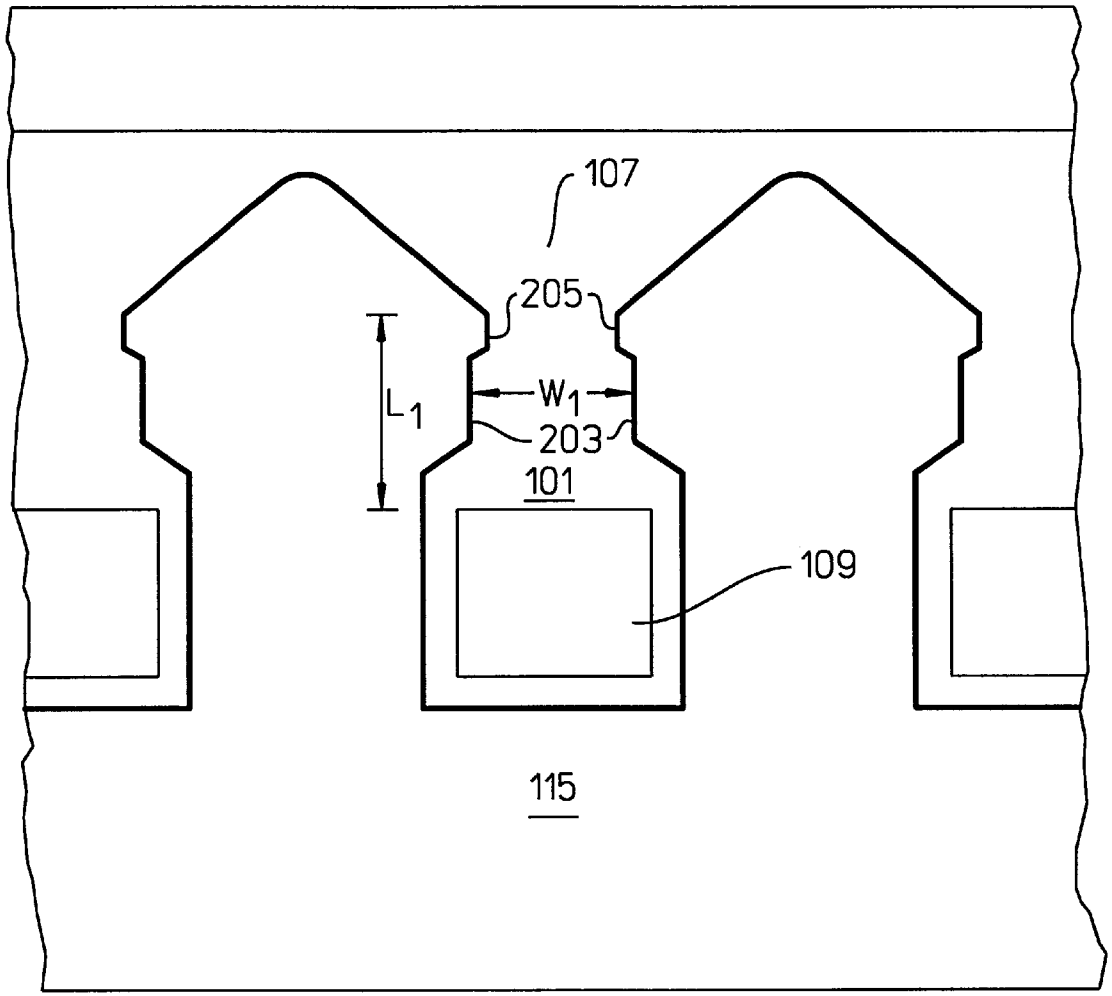
FIG. 3 is a planar view of the barrier layer and substrate of printhead of FIG. 1.

A plan view of the barrier material in the conventional printhead of FIG. 2 is shown in FIG. 3. The heater resistor 109 is disposed in the firing chamber 101 and ink is supplied via the ink feed channel 107. In order to dampen the oscillatory flow of ink, the ink feed channel 107 has been give a series of constrictions 203 and 205 of decreasing channel width and dependent upon the distance from the heater resistor 109.

In the present invention, a single printhead having multiple chambers is used for delivering more than one ink onto a print medium. The barrier layer of this multi-chamber printhead comprises different geometries, each geometry specifically designed for a given ink having different properties than the other inks. Thus, there are more than one group of firing chambers, each group dedicated to one ink.

The present invention can be used with any of the conventional barrier designs. Examples include the single ink feed channel design such as that illustrated in FIGS. 2 and 3, described above, or multi-ink feed channel barrier designs such as those described in U.S. patent application Ser. No. 08/500796, now U.S. Pat. No. 5,734,399 by Weber entitled "Particle Tolerant Inkjet Printhead Architecture", assigned to the assignee of the present invention, and incorporated herein by reference.

Figure 4:
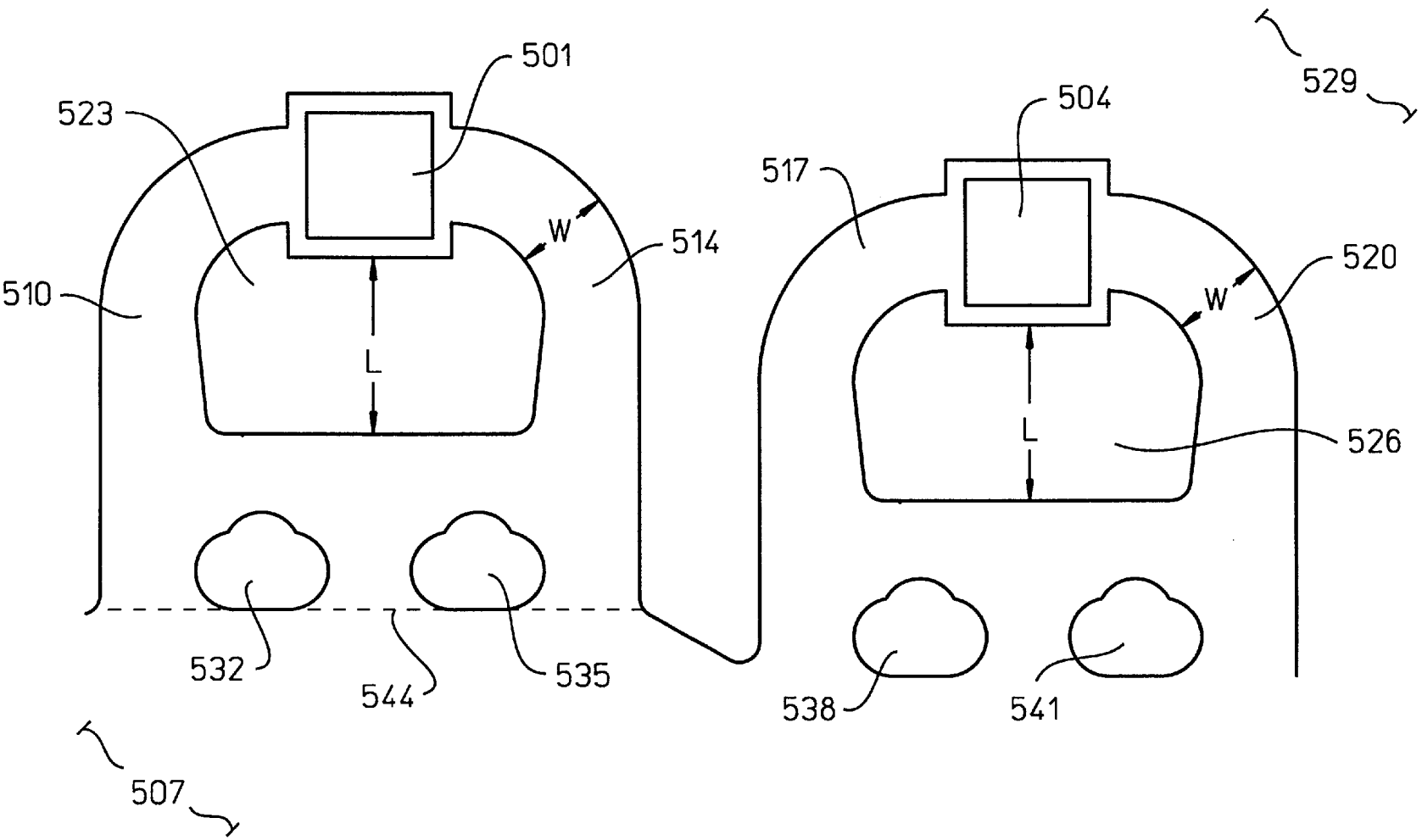
FIG. 4 is a planar view of the barrier layer of a printhead which may employ the present invention.

FIG. 4 illustrates the barrier design embodying the present invention. Two heater resistors 501 and 504 are encompassed by their associated firing chambers and supplied ink from an ink plenum 507 by way of ink feed channels 510 and 514 (for heater resistor 501) and by way of ink feed channels 517 and 520 (for heater resistor 504). The ink plenum 507 is a comparatively large volume between the substrate and the orifice plate which is coupled to a large ink source and which is a reservoir for ink to be supplied to all the firing chambers dedicated to that ink. The ink feed channels are defined, in part by the barrier islands 523 and 526 and in part by the remainder of the barrier layer 529. The floor of the firing chamber is created by the surface of the semiconductor substrate and the ceiling of the firing chamber is formed by the orifice plate. Redundant ink feed channels substantially reduces the probability that particulate matter will clog all feed channels and prevent any ink from reaching the firing chamber.

In the preferred embodiment an additional set of barrier islands is placed between the ink plenum and the redundant ink feed channels to provide additional redundant fluid paths to the resistor. Barrier islands, 532, 535, 538, and 541 are shown in association with the ink feed channels 510, 514, 517, and 520. For each firing chamber, there exists two outer barrier islands and one inner, redundant channel-defining, barrier island. More than two outer barrier islands per firing chamber are possible but the number is finite and limited by the size of islands which would be created. As the area of the island decreases, the adhesion of any island to the substrate and the orifice plate decreases, thereby creating a potential problem that a small-area island will lose adhesion to the substrate and become a plug-causing particle in its own right. The outer barrier islands are arranged in a line 544 which is parallel to the line formed by the placement of heater resistors. Since the heater resistors are typically staggered in three or more parallel lines of resistors, the lines of outer barrier islands are staggered but parallel as can be observed in FIG. 4.

The barrier layer of the present invention can be applied to the silicon wafer using conventional means. In the present invention, however, the barrier photomask includes three unique designs within each printhead, one for each group of ink firing-chambers (each group dedicated to one ink). Each barrier layer design is unique to each printhead for different pen and printer design requirements. In general, the barrier layer design is photolithographically transferred from a patterned mask into the barrier film. The resulting features generate an ink firing chamber and ink-fill channel to meet the requirement of a particular ink. The barrier process sequence begins with the barrier polymer lamination to the silicon wafer by hot roll lamination. The barrier is then exposed to UV light using an scanning projection aligner common to integrated circuit fabrication. Mask to barrier image transfer is achieved with chrome-patterned glass masks, yielding many printhead die per wafer. The UV-fixed image in the barrier is then developed as a relief image in the barrier film in a solvent blended single-wafer chamber. The barrier layer is then UV cured to complete the photo-initiated cross-linking that was started at the expose step. It should be noted, that the mask can be imaged using any other conventional means, such as the "stepper" process where each multiple-printhead field is exposed one at a time.

Three different parameters can be used to "tune" the geometry of the barrier layer for the different inks, namely, length, width, and thickness. Since a single barrier layer of uniform thickness is used for the entire wafer, the remaining two parameters, length and width, are set to different values in the photomask for the application of the barrier layer to the silicon wafer. These two parameters are used to tune the barrier geometry for the given ink. Thus, at least two geometric parameters affecting the fluidic resistance between the ink plenum which starts at the ink feed slot and the firing chambers, are needed to tune the barrier design. These two geometric parameters can be characterized as the characteristic length of the ink feed channel and the characteristic width of the ink feed channel.

In the preferred embodiment, FIG. 4, the characteristic width, of the redundant ink feed channels 510 and 514 supplying ink to the firing chamber surrounding the heater resistor 501, is defined by the width, W. The characteristic length of the ink feed channels 510 and 514) is defined by length L of the barrier island. It should be noted, that the characteristic width and characteristic length parameters are not unique to the particle tolerant design of FIG. 4 and that the same parameters, characteristic width and characteristic length, can be found in other printhead geometries such as that described in FIG. 3, and depicted as $W_1$ and $L_1$.

Figure 5:
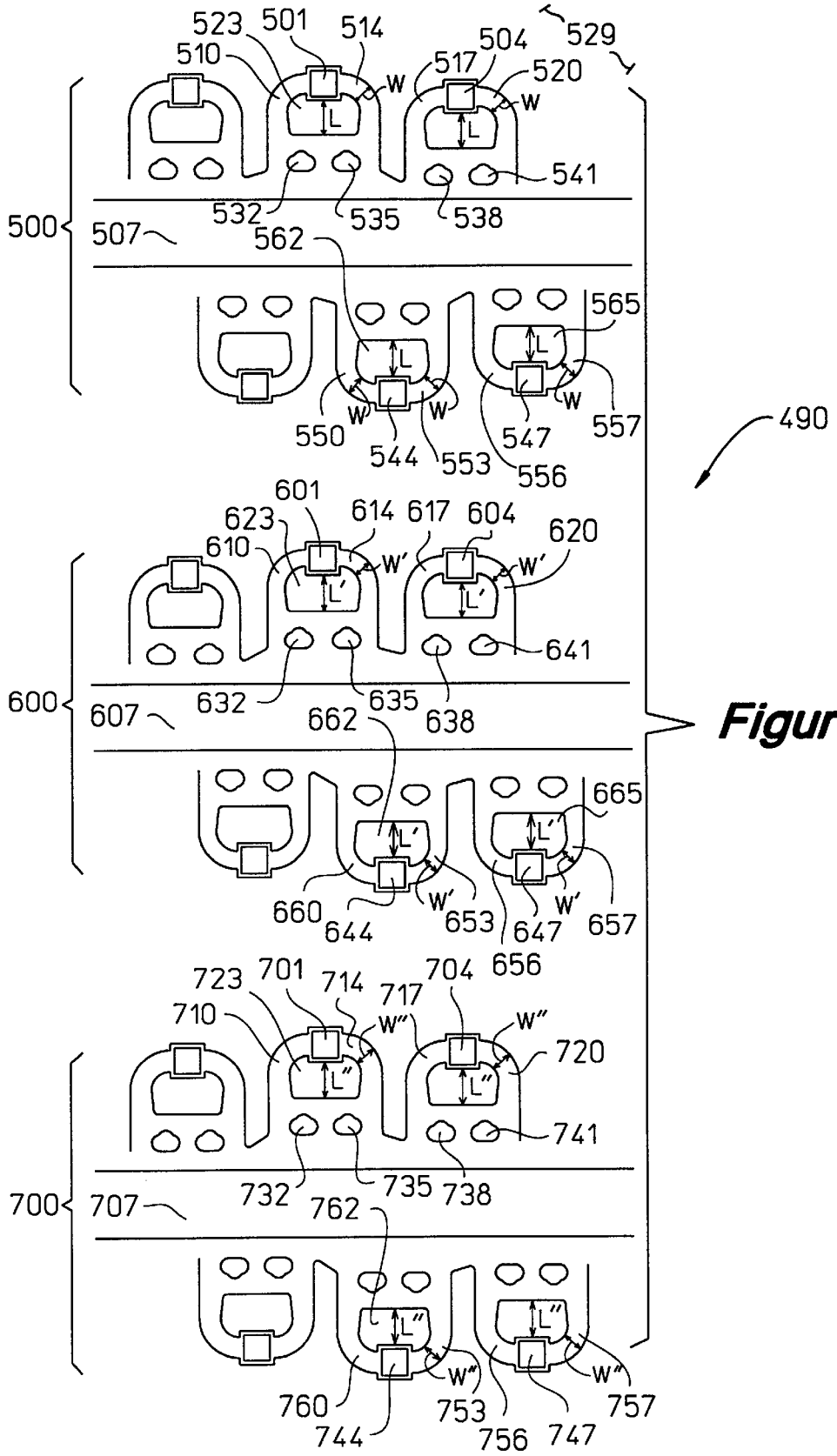
FIG. 5 is a planar view of a multi-chamber printhead which may employ the present invention, showing the relationship of the ink feed channel width and island length for different ink feed channel groups.

FIG. 5 illustrates the 3 different groups of ink feed channels embodied in the present invention. Reference numeral 490 generally indicates a multi-chamber printhead. Reference numerals 500, 600, and 700 indicate three different geometries of firing chambers and their corresponding ink slot, resistors, and the like, that are associated with three different inks, such as Yellow (Y), light Magneta ($M_L$), and dark Magenta ($M_D$), respectively. Reference numeral 500 indicates the barrier design associated with the group of firing chambers and other related components described in FIG. 4 where like references indicate like components. The firing chamber group of design 500 dedicated to the Yellow ink is located in two columns. As can be noted, the resistors 501 and 504 in one column are offset by ½ dot row from resistors 544 and 547 located in the other column. It should also be noted that the actual width of ink slot 507 and ink chamber separation dimensions are not drawn to scale. W and L indicate the characteristic width and characteristic length associated with the firing chambers for the Yellow ink.

Reference numeral 600 and 700 indicate barrier designs associated with the firing chamber groups associated with light Magneta ($M_L$), and dark Magenta ($M_D$) inks, respectively. The components in designs 600 and 700, with the exception of those so identified, are similar to those described in relation to design 500 and components described in FIG. 4. W' and L', and W" and L", indicate the characteristic widths and characteristic lengths associated with the firing chambers for the light Magenta, and the dark Magenta inks, respectively. The characteristic widths, W, W', and W" have different magnitudes in order to tune the barrier geomerty to a particular ink and its properties. It should be noted that either or both characteristic width and characteristic length can be adjusted to tune the barrier geometry.

Thus, the barrier can be "tuned" for each ink according to Equation I $$F_{2ss}=f\ (W, L, \text{Ink Property}) \qquad \text{EQUATION I}$$

wherein $F_{2ss}$=refill characteristic (Hz)

W=barrier channel width (microns)

L=barrier island length (microns)

Thus, the barrier layer of the multi-chamber printhead of the present invention, comprises different designs, each design specifically designed for a given ink having differ ent properties than the other inks. Thus, there are more than one group of firing chambers, each group dedicated to one of the inks. In each group either or both of the two characteristic geometries, namely characteristic width and characteristic length, are varied to fit a particular ink parameter such as viscosity. It should be noted, that this tuning of the characteristic width and characteristic length, is not to the exclusion of other geometry considerations such as staggering of the firing nozzles or the length of the shelf(that region between the edge of the ink refill plenum and the start of the barrier features).

In the preferred embodiment, there are two ink-jet pens, each having one multi-chamber printhead. Each of the multi-chamber printheads has three groups of firing chambers, each group dedicated to one ink. One pen 13 (FIG. 1) contains dark Magenta ($M_D$), light Magenta ($M_L$), and Yellow (Y) inks, while the other pen 14 (FIG. 1) contains dark cyan ($C_D$), light cyan ($C_L$), and black inks; dark inks having a higher colorant concentration than the light inks.

INKS

Ink-jet inks are known in the art. The ink compositions employed in the practice of the invention comprise a vehicle and a colorant. The vehicle contains water and at least one co-solvent. The colorant may comprise one or more pigment dispersions, or one or more dispersed water-insoluble dyes, or one or more water-miscible dyes, preferably, water-miscible dyes.

The black inks suitably employed in the practice of the invention can be dye based or pigment-based colorant. Suitable black dye-based inks are disclosed and claimed, for example, in U.S. Pat. No. 4,963,189, entitled "Waterfast Ink Formulations with a Novel Series of Anionic Dyes Containing Two or More Carboxyl Groups"; and U.S. patent application Ser. No. 08/741880, now U.S. Pat. No. 5,725,641 entitled "Lightfast Inks for Inkjet Printing," assigned to the present assignee and incorporated herein by reference. Suitable black pigment-based inks are disclosed and claimed, for example, in U.S. Pat. No. 5,085,698, entitled "Aqueous Pigmented Inks for Ink Jet Printers"; U.S. Pat. No. 5,221,334, entitled "Aqueous Pigmented Inks for Ink Jet Printers"; and U.S. Pat. No. 5,302,197, entitled "Ink Jet Inks"; all assigned to E. I. Du Pont de Nemours and Company. Suitable color inks are disclosed and claimed, for example, in U.S. Pat. No. 5,858,075, (unknown), filed on Mar. 3, 1997 by Deardurff et. al., entitled "Dye set for Improved Ink-Jet Image Quality," assigned to the present assignee and incorporated herein by reference; and U.S. Pat. No. 5,788,754, filed on Mar. 3, 1997 by Deardurff et. al., entitled "Ink-Jet Inks for Improved Image Quality," assigned to the present assignee and incorporated herein by reference.

The inks of the present invention comprise an aqueous vehicle comprising at least one water soluble organic solvent; and optionally one component independently selected from the group consisting of surfactants, buffers, biocides, and metal chelators; and the balance water. The inks may further include water miscible polymers.

The viscosity of the inks is dependent on the type and amount of each ingredient in the ink composition. For example, the viscosity can increase as the concentration of the colorant in the ink increases or as the organic solvent concentration is changed.

The viscosity of the inks employed in the practice of the invention ranges from about 0.5 to about 10 cps at ambient conditions. The preferred and most preferred ink viscosities, at ambient conditions, are listed in Table 1.

TABLE 1

| INK | PREFERRED from about to about (cps) | MOST PREFERRED about (cps) |
|---|---|---|
| Black | 1.0–3.0 | 1.5–2.5 |
| $Cyan_D$ | 1.0–3.0 | 1.5–2.5 |
| $Cyan_L$ | 1.0–3.0 | 1.3–2.5 |
| Yellow | 1.0–3.0 | 1.5–2.5 |
| $Magenta_D$ | 1.0–3.0 | 1.5–2.5 |
| $Magenta_L$ | 1.0–3.0 | 1.0–2.5 |

EXAMPLES

In order to "tune" the barrier design for ink viscosity an empirical model according to Equation II was created. This model was based on Equation I.

$$F_{2ss}=2.18+0.104\ W+0.0272\ L-2.76\eta+7.59\ Dh/(\eta^*L) \qquad \text{EQUATION II}$$

wherein $F_{2ss}$=refill characteristic (Hz)

W=barrier channel width (microns)

L=barrier island length (microns)

η=ink viscosity at 42° C.[1] (centipoise)

D =hydraulic diameter of ink channel (microns) wherein Dh=4*cross-sectional area of conduit/(wetted perimeter)

[1] the temperature of the bulk ink as it flows into the firing chamber.

Equation II was developed by designing an experimental barrier mask, referred to as a matrix mask, in which key aspects of barrier geometry (e.g., island length, channel width) were systematically varied. Ink-jet pens were built with this matrix mask on several barrier thicknesses. Inks, having different properties such as viscosity, were tested for refill characteristic performance in the ink-jet pens. Statistical regression techniques were then used to find the relationship which best explained refill characteristic as a function of barrier geometry and ink viscosity.

Inks were formulated having the following compositions. The concentrations of the yellow, cyan, and magenta dyes at maximum UV-vis absorbance at a 1:10,000 dilution were

| | |
|---|---|
| Yellow ink[2] | absorbance of 0.07 at 402 nm |
| Black ink[3] | absorbance of 0.09 ~ 570 nm |
| $Cyan_D$ ink[4] | absorbance of 0.09 at 618 nm |
| $Magenta_D$ ink[5] | absorbance of 0.07 at 518 nm |

The concentration of the dyes in the light inks, namely $Cyan_L$[4], and $Magenta_L$[5], was 15% of the corresponding dark inks ($Cyan_D$, ad $Magent_D$).

[2] Yellow 104 available from Ilford AG, Rue de l'Industrie, CH-1700 Fribourg, Switzerland

[3] Hydrolyzed Reactive Black 31 dye hydrolyzed to contain either or both the hydrolyzed forms, namely, vinyl sulfone form and ethyl hydroxy form, Reactive Black 31 available from vendors such as Hoechst Chemical Company and Bayer as Remazol Black RL Reactive Black 31

[4] Direct Blue 199

[5] Magenta 377 available from Ilford AG, Rue de l'Industrie, CH-1700 Fribourg, Switzerland

| The aqueous vehicle comprised: | |
|---|---|
| organic solvent | 10% 1,2-hexanediol |
| alcohol | 2% n-butanol |
| surfactant | 1% Tergitol 15-S-5 |
| buffer | 0.2% MES |
| metal chelator | 0.2% EDTA |
| biocide | 0.2% Proxel GXL |
| Water | balance of mixture |

The viscosity of the formulated inks at 42° C. was measured according to standard procedures and is reported in Table 2, below:

TABLE 2

| INK | VISCOSITY (cps) |
|---|---|
| Black | 1.20 |
| $Cyan_D$ | 1.13 |
| $Cyan_L$ | 1.04 |
| Yellow | 1.18 |
| $Magenta_D$ | 1.13 |
| $Magenta_L$ | 1.06 |

The inks were filled into two groups of multi-chamber ink-jet pens. In the first group, the barrier geometry for each of the firing chambers associated with a particular ink, was compensated for the ink viscosity. For comparison, the barrier geometry of the pens in the second group were not compensated for the variation in ink viscosity from chamber to chamber. Half of the pens in each group were filled with dark Magenta ($M_D$), light Magenta ($M_L$), and Yellow (Y) inks, respectively, for supplying ink to a specific group of firing chambers. The remaining pens in each group were filled with dark Cyan ($C_D$), light Cyan ($C_L$), and Black (K) inks.

The refill frequency, $F_{2ss}$ was measured for each of the pens. The results for the first and second groups of pens are reported as box-and-whisker plots in FIGS. 7 and 6, respectively. In a box plot the horizontal line in the middle of the box marks the median of the sample. The edges of each box, called hinges, mark the 25th and 75th percentiles. Thus, the central 50% of the data values fall within the range of the box. The length of the box (the difference between the values of the hinges) is called hspread and corresponds to the interquartile range. The whiskers (vertical lines extending up and down from each box) show the range of values that fall within 1.5 hspreads of the hinges (1.5 hspreads can be longer than a whisker). Points not falling within the above mentioned areas are identified with filled circle symbols.

Figure 6:
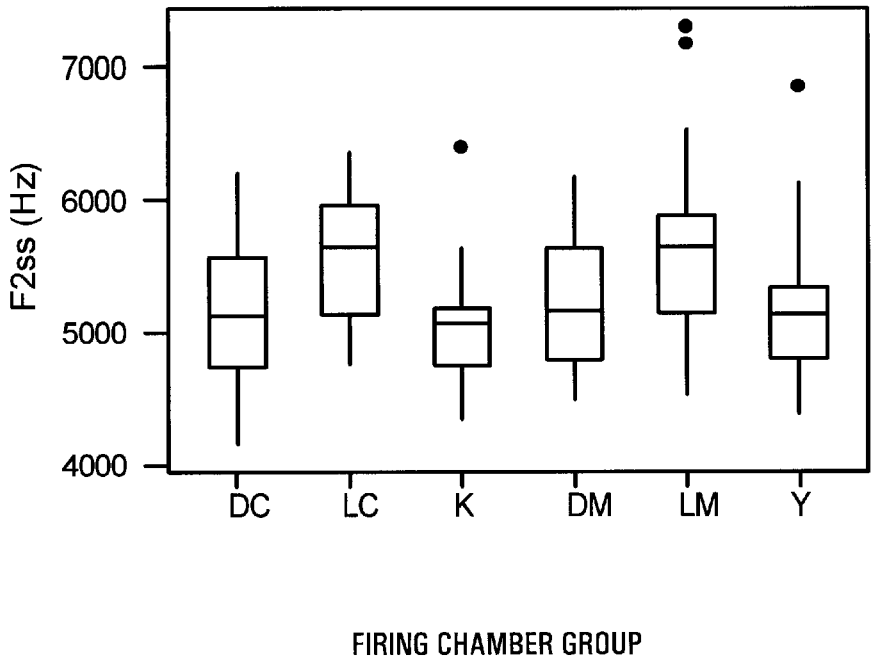
FIGS. 6 and 7 depict the refill frequency for two groups of pens, one group compensated for ink viscosity and the other not, respectively.
Figure 7:
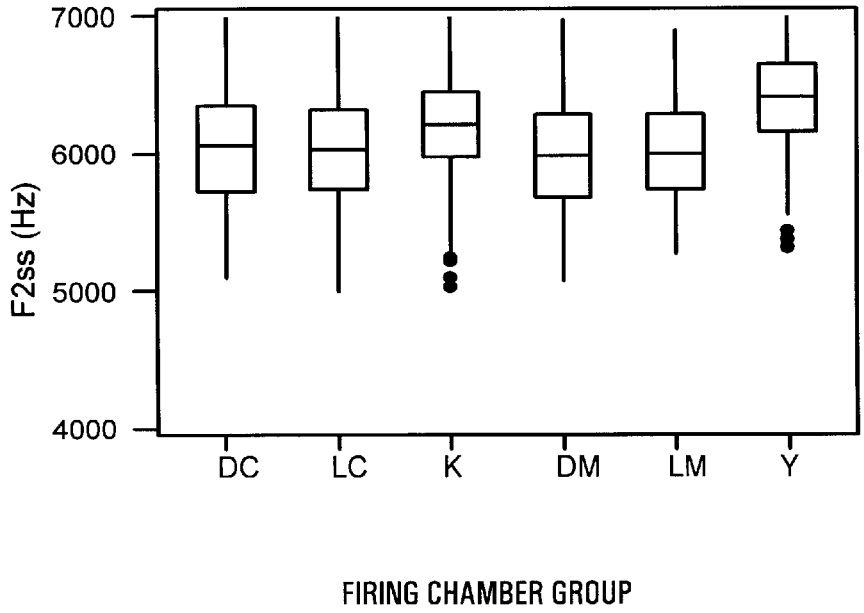

As can be noted from FIGS. 6 and 7, the viscosity compensated barrier design provided for chamber-to-chamber refill frequencies that were much more similar in each of the pens.

Figure 8:
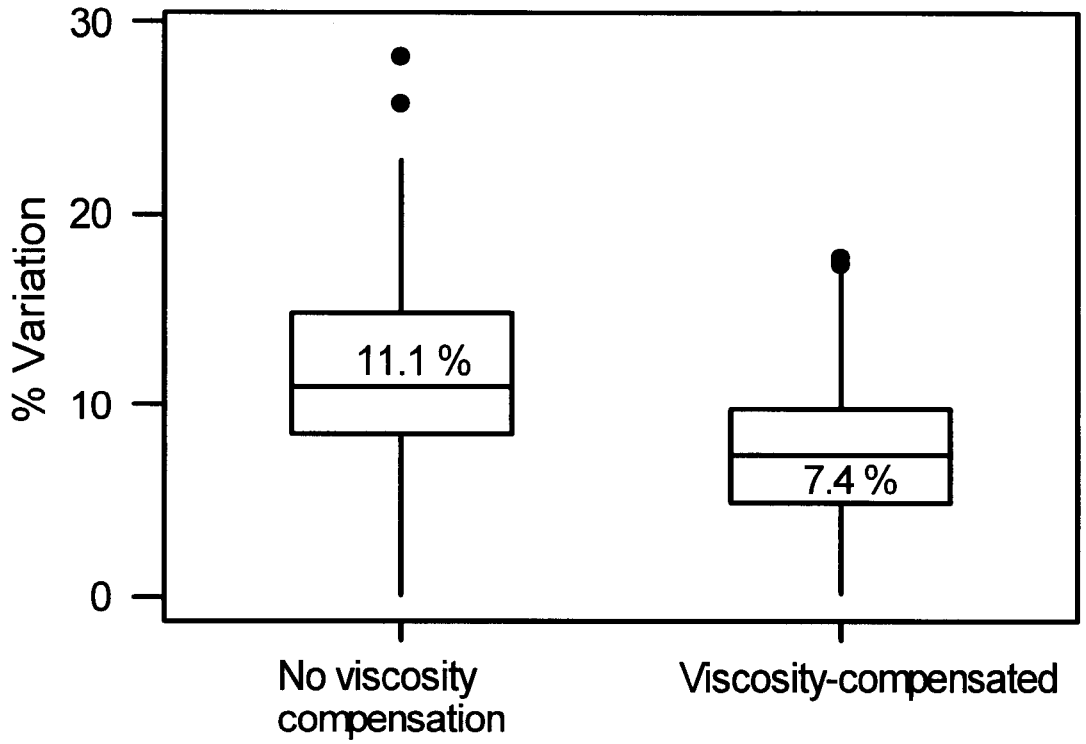
FIG. 8 depcits the percent variation for refill frequency across pens of FIGS. 6 and 7.

FIG. 8 represents pen-level percent variation for refill frequency for the pens in each of the two groups. Percent variation was calculated for each pen using Equation III, below:

$$\% \text{ variation} = \text{range of } F_{2ss} \text{ across pen/average } F_{2ss} \text{ for pen} \qquad \text{EQUATION III}$$

As can be noted from FIG. 8, the percent variation for the viscosity compensated design was much less than that for the control pens.

Thus, it has been demonstrated that multi-chamber pens designed with ink property compensated barrier designs according to the present invention provide more consistent refill frequencies. As can be appreciated, the invention is designed to accommodate many types of inks having different properties (e.g., viscosities, surface tenstion).

It should be appreciated, that the ink reservoirs providing ink to the nozzles of the printhead can be supplied from within the print cartridge or supplied from a remote location and that the term "print cartridge" is meant to include both types of ink containment, on-board (i.e., the reservoir for storing the ink is placed in the print cartridge) and off-board (i.e., the ink reservoir is mounted off-board) ink reservoirs.

It should also be noted that the use of any specific color or ink combination is for illustrative purposes only and that the invention can be applied to any other color and ink combination. It should also be appreciated that the use of any specific ink formulation is for illustrative purposes only and that the invention can be applied to any other ink formulation having different solvents, colorants, and additional ingredients.

Although, specific embodiments of the invention have been described and illustrated, the invention is not to be limited to the specific forms or arrangement of parts so described and illustrated. The invention is limited only by the claims.

What is claimed is:

1. An ink-jet printhead for selectively ejecting a plurality of fluids in response to a print control system, said printhead comprising a single substrate having a surface substantially perpendicular to a direction of election of a plurality of fluids;

a first fluid geometry provided on said substrate, providing a first fluid to a first firing chamber, said first fluid geometry configured to accommodate a first fluid parameter of the first fluid at approximately 40° C.; and a second fluid geometry, provided on said substrate, providing a second fluid to a second firing chamber, said second fluid geometry being different than said first fluid geometry and configured to accommodate a second fluid parameter of the second fluid at approximately 40° C., the sccond fluid parameter of the second fluid having a value different from a value of the first fluid parameter of the first fluid, said first and second fluid geometries selected to provide substantially similar refill characteristics at approximately 40° C.

2. The printhead of claim 1 further comprising a barrier layer disposed between an orifice layer and the substrate for defining a fluid feed channel, said fluid feed channel for providing fluid to its corresponding firing chamber.

3. The printhead of claim 2 wherein each of the fluid geometries is defined by at least one of length, width, and height of the fluid feed channel.

4. The printhead of claim 1 wherein the refill characteristic is defined by $$F_{2ss}=2.18+0.104\ W+0.0272\ L-2.76\eta+7.59\ Dh/(\eta*L).$$

5. The printhead of claim 1 wherein said first fluid geometry and said second fluid geometries are configured for said fluid parameter of said first fluid and said second fluid at a temperature of about 42° C., and wherein said first and second fluid geometries are selected to provide substantially similar refill characteristics at approximately 42° C.

6. An ink-jet print system of a type having a printhead for selectively ejecting a plurality of fluids in response to a print control system, said print system comprising:

a printhead comprising a single substrate having a surface substantially perpendicular to a direction of ejection of a plurality of fluids;

a first fluid architecture, provided on said substrate, providing a first fluid to a first firing chamber, said first fluid architecture configured to accommodate a first fluid parameter ofthe first fluid at approximately 40° C.; and a second fluid architecture, provided on said substrate, providing a second fluid to a second firing chamber, said second fluid architecture being different than said first fluid architecture and configured to accommodate a second fluid parameter of the second fluid at approximately 40° C., the second fluid parameter of the second fluid having a value different from a value of the first fluid parameter of the first fluid, said first and second fluid architectures selected to provide substantially similar refill characteristics at approximately 40° C.

7. The print system of claim 6 further comprising a barrier layer disposed between an orifice layer and the substrate for defining a fluid feed channel, said fluid feed channel for providing fluid to its corresponding firing chamber.

8. The print system of claim 7 wherein each of the fluid architectures is defined by at least one of length, width, and height of the fluid feed channel.

9. The print system of claim 6 wherein the refill characteristic is defined by $$F_{2ss}=2.18+0.104\ W+0.0272\ L-2.76\eta+7.59\ Dh(\eta*L).$$

10. The print system of claim 6 further comprising a fluid set comprising at least a first fluid having a fluid parameter having a first value, and a second fluid having a second value for the same fluid parameter is the fluid parameter of the first fluid, the second value being different than the first value.

11. The print system of claim 10 wherein the fluid parameter is viscosity and ranges from about 0.5 to about 10 centipoise.

12. The print system of claim 11 wherein the viscosity ranges from about 1 to about 3 centipoise.

13. The print system of claim 12 wherein the viscosity ranges from about 1 to about 2.5 centipoise.

14. The print system of claim 6 further comprising a print controller.

15. The system of claim 6 wherein said first and second fluid geometries are configured for said fluid parameter of said first fluid and said second fluid at a temperature of about 42° C., and wherein said first and second fluid geometries are selected to provide substantially similar refill characteristics at approximately 42° C.

16. A method for making a barrier layer for an ink-jet printhead for selectively ejecting a plurality of fluids in response to a print controller, comprising the steps of:

providing a barrier layer;

providing a mask having a plurality of designs, each design optimized for a different fluid;

providing a single substrate having a surface substantially perpendicular to a direction of ejection of a plurality of fluids;

forming a plurality of fluid geometries on said barrier layer using said mask, said plurality of fluid geometries comprising a first fluid geometry provided on said substrate, providing a first fluid to a first firing chamber, said first fluid geometry configured to accommodate a first fluid parameter of the first fluid at approximately 40° C.; and a second fluid geometry, provided on said substrate, providing a second fluid to a second firing chamber, said second fluid geometry being different than said first fluid geometry and configured to accommodate a second fluid parameter of the second fluid at approximately 40° C., the second fluid parameter of the second fluid having a value different from a value of the first fluid parameter of the first fluid, said first and second fluid geometries selected to provide substantially similar refill characteristics at approximately 40° C.

17. The method of claim 16 wherein each of said fluid geometries is defined by at least one of length, width, and height of the fluid feed channel.

18. The method of claim 17 wherein the refill characteristic is defined by $$F_{2ss}=2.18+0.104\ W+0.0272\ L-2.76\eta+7.59\ Dh/(\eta*L).$$

19. The method of claim 16 wherein said first and second fluid geometries are configured for said fluid parameter of said first fluid and said second fluid at a temperature of about 42° C., and wherein said first and second fluid geometries are selected to provide substantially similar refill characteristics at approximately 42° C.

20. The method for providing ink to a printhead, comprising the steps of:

providing a single substrate having a surface substantially perpendicular to a direction of election of a plurality of fluids;

providing ink to a printhead, said printhead comprising a first fluid geometry, provided on said substrate, providing a first fluid to a first firing chamber, said first fluid geometry configured to accommodate a first fluid parameter of the first fluid at approximately 40° C.; and a second fluid geometry, provided on said substrate, providing a second fluid to a second firing chanmer, said second fluid geometry being different than said first fluid geometry and configured to accommodate a second fluid parameter of the second fluid at approximately 40° C., the second fluid parameter of the second fluid having a value different from a value of the first fluid parameter of the first fluid, said first and second fluid gcometries selected to provide substantially similar refill characteristics at approximately 40° C.

21. The method of claim 20 wherein the viscosity of said ink ranges from about 0.5 to about 10 centipoise.

22. The method of claim 21 wherein the viscosity of said ink ranges from about 1 to about 3 centipoise.

23. The method of claim 20 wherein the refill characteristic is defined by $$F_{2ss}=2.18+0.104\ W+0.0272\ L-2.76\eta+7.59\ Dh/(\eta*L).$$

24. The method of claim 20 wherein said first and second fluid geometries are configured for said fluid parameter of said first fluid and said second fluid at a temperature of about 42° C., and wherein said first and second fluid geometries are selected to provide substantially similar refill characteristics at approximately 42° C.

* * * * *

UNITED STATES PATENT AND TRADEMARK OFFICE

CERTIFICATE OF CORRECTION

PATENT NO. : 6,247,798 B1
DATED : June 19, 2001
INVENTOR(S) : Cleland et al.

It is certified that error appears in the above-identified patent and that said Letters Patent is hereby corrected as shown below:

Column 10,
Line 27, delete “comprising” and insert therefor -- comprising: --
Line 30, delete “geometry” and insert therefor -- geometry, --.
Line 39, delete “sccond” and insert therefor -- second --.

Column 11,
Line 4, delete “ofthe” and insert therefor -- of the --.
Line 61, delete “geometry” and insert therefor -- geometry, --.

Signed and Sealed this

Third Day of February, 2004

JON W. DUDAS
*Acting Director of the United States Patent and Trademark Office*